US007217233B2

(12) United States Patent
Masaki et al.

(10) Patent No.: US 7,217,233 B2
(45) Date of Patent: May 15, 2007

(54) PARALLEL FOLDING APPARATUS OF FOLDING MACHINE

(75) Inventors: Akira Masaki, Noda (JP); Takao Watanabe, Noda (JP)

(73) Assignee: Komori Corporation, Tokyo (JP)

( * ) Notice: Subject to any disclaimer, the term of this patent is extended or adjusted under 35 U.S.C. 154(b) by 43 days.

(21) Appl. No.: 11/116,368

(22) Filed: Apr. 28, 2005

(65) Prior Publication Data

US 2005/0245380 A1 Nov. 3, 2005

(30) Foreign Application Priority Data

Apr. 30, 2004 (JP) ..... 2004-136134

(51) Int. Cl.
*B31F 1/08* (2006.01)

(52) U.S. Cl. ..... 493/432; 493/424; 493/425; 493/434; 493/442

(58) Field of Classification Search ..... 493/424–428, 493/432, 434, 442, 454
See application file for complete search history.

(56) References Cited

U.S. PATENT DOCUMENTS

| | | | | |
|---|---|---|---|---|
| 4,807,865 A | | 2/1989 | Kobler et al. | |
| 5,226,871 A | * | 7/1993 | Skipor | 493/425 |
| 5,522,586 A | * | 6/1996 | Bennett et al. | 270/8 |
| 5,839,365 A | * | 11/1998 | Calbrix et al. | 101/226 |
| 6,367,792 B1 | * | 4/2002 | Chagnon | 270/5.02 |
| 6,446,961 B1 | * | 9/2002 | Foret et al. | 271/259 |
| 6,644,186 B2 | * | 11/2003 | Herrou et al. | 101/227 |

FOREIGN PATENT DOCUMENTS

| | | | |
|---|---|---|---|
| DE | 10343165 | A1 | 4/2005 |
| EP | 1209112 | A2 | 5/2002 |
| GB | 1005531 | A | 9/1965 |
| JP | 02-221063 | A | 9/1990 |
| JP | 10-129929 | A | 5/1998 |
| JP | 2000-95431 | A | 4/2000 |

* cited by examiner

*Primary Examiner*—Hemant M. Desai
(74) *Attorney, Agent, or Firm*—Birch, Stewart, Kolasch & Birch, LLP

(57) ABSTRACT

A parallel folding apparatus of a folding machine comprises a first cylinder in contact with a second cylinder. A guide plate guides a signature transported on the lower circumferential surface of the second cylinder after being double-folded by grippers of the second cylinder in cooperation with knives of the first cylinder. The guide plate comprises a stationary guide located downstream, in the rotating direction, of the point of contact between the first cylinder and the second cylinder and disposed continuously along the circumferential surfaces of the first cylinder and the second cylinder, and a moving guide movable in accordance with the operating speed of the folding machine between a position, closer to the circumferential surface of the first cylinder than the stationary guide, and a position, more remote from the circumferential surface of the first cylinder than the stationary guide.

12 Claims, 6 Drawing Sheets

PARALLEL FOLDING APPARATUS OF FOLDING MACHINE

CROSS REFERENCE TO RELATED APPLICATION

The entire disclosure of Japanese Patent Application No. 2004-136134 filed on Apr. 30, 2004, including specification, claims, drawings and summary, is incorporated herein by reference in its entirety.

BACKGROUND OF THE INVENTION

1. Field of the Invention

This invention relates to a parallel folding apparatus of a folding machine, which can smoothly perform transfer of a signature between a first jaw cylinder and a second jaw cylinder during parallel folding.

2. Description of the Related Art

A web rotary printing press is equipped with a folding machine for cutting a web, which has been dried and cooled after printing, into predetermined lengths, and folding the cut web in a width direction or a lengthwise direction.

The folding machine is available with various structures and, for example, is equipped with a parallel folding apparatus as shown in FIG. 4 or FIG. 5 (see Japanese Patent Application Laid-Open No. 2000-95431; hereinafter referred to as Patent Document 1).

The parallel folding apparatus has a cut-off cylinder 1, a folding cylinder 2, a first jaw cylinder 3, and a second jaw cylinder 4 opposed to one another in contact with one another and rotating in directions of arrows in FIG. 4. A web 8, which has been fed between nipping rollers 5→cross perforation cylinders 6→nipping rollers 7, is cut to predetermined dimensions by a cut-off knife (not shown) of the cut-off cylinder 1. The front end of the cut web is transported by a pin (not shown) of the folding cylinder 2, and then the cut web is parallel-folded between a single folding knife (not shown) of the folding cylinder 2 and a site between a gripper board 10 and a gripper jaw 11 of the first jaw cylinder 3 to form a signature 9. In the case of a single parallel fold, the signature 9 is transported, unchanged, toward a chopper 14 by a gripper 12 and a gripper pad 13 of the second jaw cylinder 4. In the case of a double parallel fold or a delta fold, the signature 9 is further parallel-folded between a double folding knife (not shown) of the first jaw cylinder 3 and a site between a gripper board 15 and a gripper jaw 16 of the second jaw cylinder 4 to form a double parallel fold. The so folded signature 9 is transported toward the chopper 14.

In FIG. 5, 17*a* to 17*c* denote signature transport/holding brushes used in the transfer of the signature 9 between the first jaw cylinder 3 and the second jaw cylinder 4. Instead of these signature transport/holding brushes 17*a* to 17*c*, a continuous guide plate 18 may conventionally be provided to provide along the circumferential surface of the first jaw cylinder 3 and the circumferential surface of the second jaw cylinder 4, as shown in FIG. 6.

In providing the continuous guide plate 18 along the circumferential surface of the first jaw cylinder 3 and the circumferential surface of the second jaw cylinder 4 in a folding machine as described in patent document 1, it has been conventional practice to provide the guide plate 18 stationarily (although its initial position can be adjusted) with respect to a stay bar 19 extending between frames.

To have a double parallel fold or a delta fold, the front end of the signature 9 gripped between the gripper board 10 and the gripper jaw 11 (see FIG. 4) of the first jaw cylinder 3 is released at a predetermined time point (the time point before the folded portion of the signature 9 is gripped, for gripping change, between the double folding knife of the first jaw cylinder 3 and the site between the gripper board 15 and the gripper jaw 16 of the second jaw cylinder 4) after passing through the point of contact between the first jaw cylinder 3 and the second jaw cylinder 4. During a low speed operation of the folding machine (during acceleration at the start of operation, or during speed reduction at completion of operation), the following problem may occur at the time of release: That is, the front end of the signature 9 is not guided into a clearance between the guide plate 18 and the circumferential surface of the first jaw cylinder 3, but enters a space between the guide plate 18 and the circumferential surface of the second jaw cylinder 4. As a result, the trouble may occur that the signature 9 is folded up in a curled state, or dropped without being folded up, whereby a jam is caused. That is, during a low speed operation, the front end of the signature 9 is not guided into the clearance between the guide plate 18 and the circumferential surface of the first jaw cylinder 3, but enters the space between the guide plate 18 and the second jaw cylinder 4, because of weak inertia. Consequently, the signature 9 is not guided by the guide plate and the circumferential surface of the first jaw cylinder. In other words, during a high speed operation (during a routine constant speed operation), the front end of the signature 9 is positively guided into the clearance between the guide plate 18 and the circumferential surface of the first jaw cylinder 3 by means of inertia, so that there is no problem. If the guide plate is located toward the site of contact between the first jaw cylinder and the second jaw cylinder, on the other hand, the front end of the signature 9 is guided by the guide plate during a low speed operation, but the trouble arises that the signature is rubbed by the guide plate during a high speed operation. Even in the case of the signature transport/holding brushes 17*a* to 17*c*, the brushes 17*a* to 17*c* wear and become unable to guide the signature, presenting the same problems as those caused by the guide plate 18.

SUMMARY OF THE INVENTION

The present invention has been accomplished in light of the above-described problems. An object of the present invention is to provide a parallel folding apparatus of a folding machine, which can smoothly perform the transfer of a signature between first and second jaw cylinders during parallel folding, regardless of the operating speed of the folding machine.

To attain the above object, there is provided, according to the present invention, a parallel folding apparatus of a folding machine, comprising a first cylinder and a second cylinder arranged, with circumferential surfaces of the first cylinder and the second cylinder being in contact with each other, further comprising a guide member for guiding a signature which is transported on a lower circumferential surface of the second cylinder after being parallel-folded by gripping/holding means of the second cylinder in cooperation with knives of the first cylinder, the guide member comprising a stationary guide which is located downstream, in a rotating direction, of a point of contact between the first cylinder and the second cylinder and disposed along the circumferential surface of the first cylinder and the circumferential surface of the second cylinder, and a moving guide which is disposed in such a manner as to be movable by drive means in accordance with an operating speed of the folding machine between a close position, where the moving guide is closer to the circumferential surface of the first cylinder and the circumferential surface of the second cylinder than the stationary guide in a range defined by the stationary guide, the first cylinder and the second cylinder, and a remote position, where the moving guide is as remote as, or more remote than, the stationary guide from the circumferential surface of the first cylinder and the circumferential surface of the second cylinder outside the range.

The moving guide may have moving guide portions separated from one another by a predetermined spacing in an axial direction, the stationary guide may have stationary guide portions separated from one another by a predetermined spacing in an axial direction, and the moving guide portions can advance and retreat through the spacings between the stationary guide portions.

The second cylinder may be located below the first cylinder and may make contact with the first cylinder.

The drive means may act to locate the moving guide at the close position when the operating speed of the folding machine is equal to or lower than a predetermined speed, and to locate the moving guide at the remote position when the operating speed of the folding machine exceeds the predetermined speed.

The predetermined speed may be 200 rpm.

The moving guide may be located at the close position when the signature is folded between the first cylinder and the second cylinder.

The moving guide may be located at the remote position when the signature is not folded between the first cylinder and the second cylinder.

The first cylinder may be a first jaw cylinder for forming a signature in cooperation with a folding cylinder, and the second cylinder may be a lower second jaw cylinder for folding the signature in cooperation with the first jaw cylinder or for receiving the signature from the first jaw cylinder without folding the signature.

The parallel folding apparatus may further comprise an upper second jaw cylinder which is opposed to the first jaw cylinder on a side upstream, in a rotating direction of the first jaw cylinder, of an opposing position where the first jaw cylinder and the lower second jaw cylinder are opposed to each other, and on a side downstream, in the rotating direction of the first jaw cylinder, of an opposing position where the folding cylinder and the first jaw cylinder are opposed to each other.

The stationary guide may have a first guide surface opposed to the first cylinder and having a curved portion separated by a predetermined distance from the circumferential surface of the first cylinder; a second guide surface opposed to the second cylinder and having a curved portion separated by a predetermined distance from the circumferential surface of the second cylinder; and a third guide surface which establishes communication between the first guide surface and the second guide surface in such a manner as to have a curved portion pointing toward a position where the first cylinder and the second cylinder are opposed to each other, and the moving guide may have a guide surface having a curved portion pointing toward the position where the first cylinder and the second cylinder are opposed to each other.

The close position may be a position where the guide surface is closer than the third guide surface to the position where the first cylinder and the second cylinder are opposed to each other.

A plurality of the moving guide portions may be supported with spacing by a support member, and the stationary guide may have a plurality of notches corresponding to the moving guide portions.

According to the above-described features of the present invention, during a low speed operation at the time of parallel folding (during acceleration at the start of operation or during speed reduction at completion of operation), the moving guide is moved to the position closer to the circumferential surface of the first jaw cylinder than the stationary guide. As a result, the front end of the signature gripped by the gripping/holding means of the first jaw cylinder is guided into the clearance between the moving guide and the circumferential surface of the first jaw cylinder at an early time point after passage through the point of contact between the first jaw cylinder and the second jaw cylinder. This prevents the occurrence of the trouble, as in the earlier technologies, that the front end of the signature enters between the guide plate and the circumferential surface of the second jaw cylinder, with the result that the signature is folded in a bent state or a jam occurs.

On the other hand, during a high speed operation (for example, during a routine constant speed operation) in the case of parallel folding, the moving guide is moved to the position more remote from the circumferential surface of the first jaw cylinder than the stationary guide. Thus, the front end of the signature is positively guided, as usual, by inertia into the clearance between the stationary guide and the circumferential surface of the first jaw cylinder, so that no problem is caused. In other words, the event that the moving guide is located excessively forward (keeps staying at the position close to the circumferential surface of the first jaw cylinder), and its end portion on the side of the second jaw cylinder forms an edge, thereby rubbing the signature, can be avoided.

According to the present invention, as described above, the transfer of the signature between the first jaw cylinder and the second jaw cylinder in the case of parallel folding can be performed smoothly. Furthermore, the moving guide can be moved by the drive means, thus facilitating automation.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A parallel folding apparatus of a folding machine according to the present invention will now be described in detail by an embodiment with reference to the accompanying drawings, which in no way limit the invention.

Figure 1:
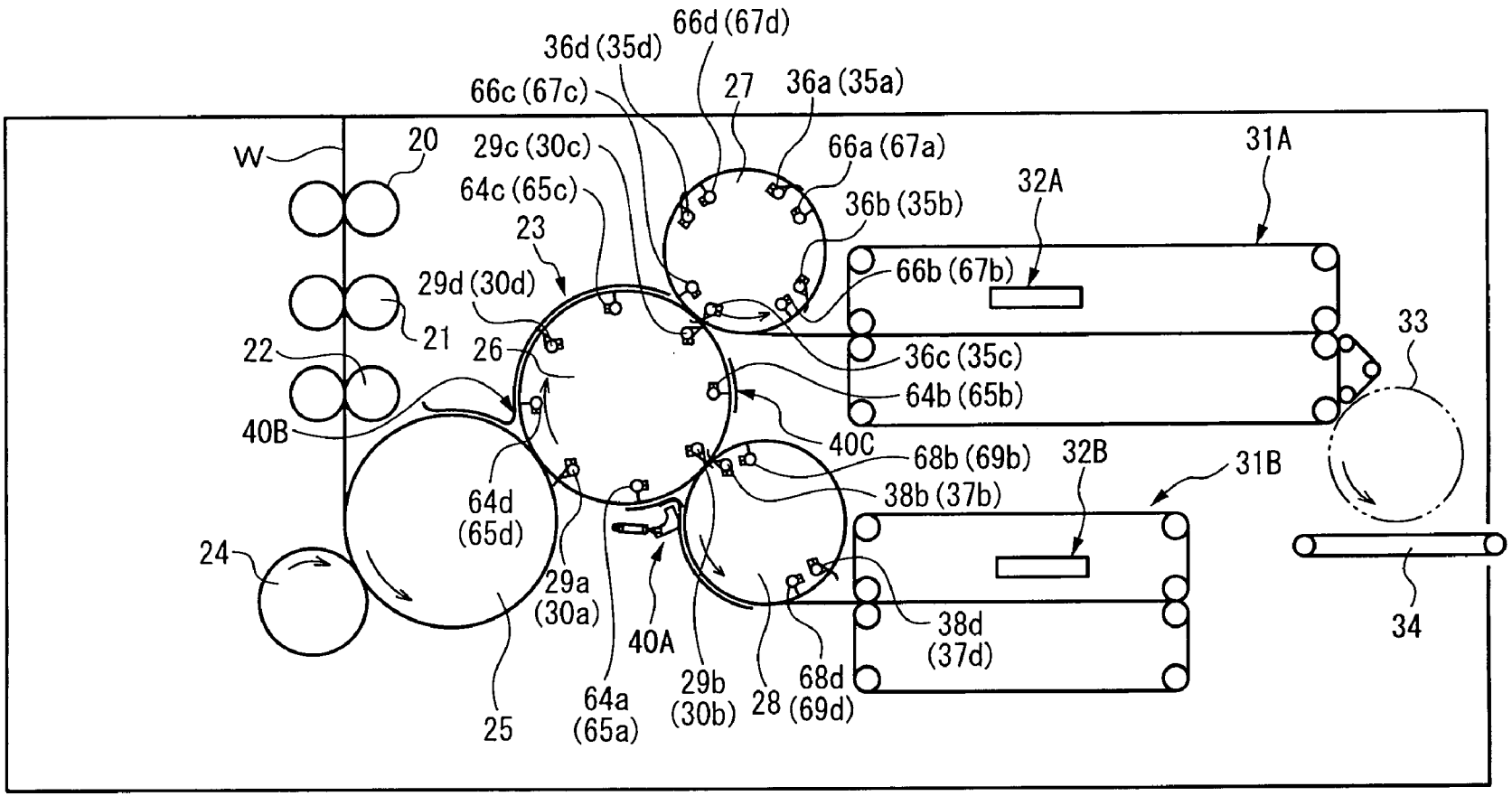
FIG. 1 is a schematic side view of a folding machine of a rotary printing press, showing an embodiment of the present invention.
Figure 2:
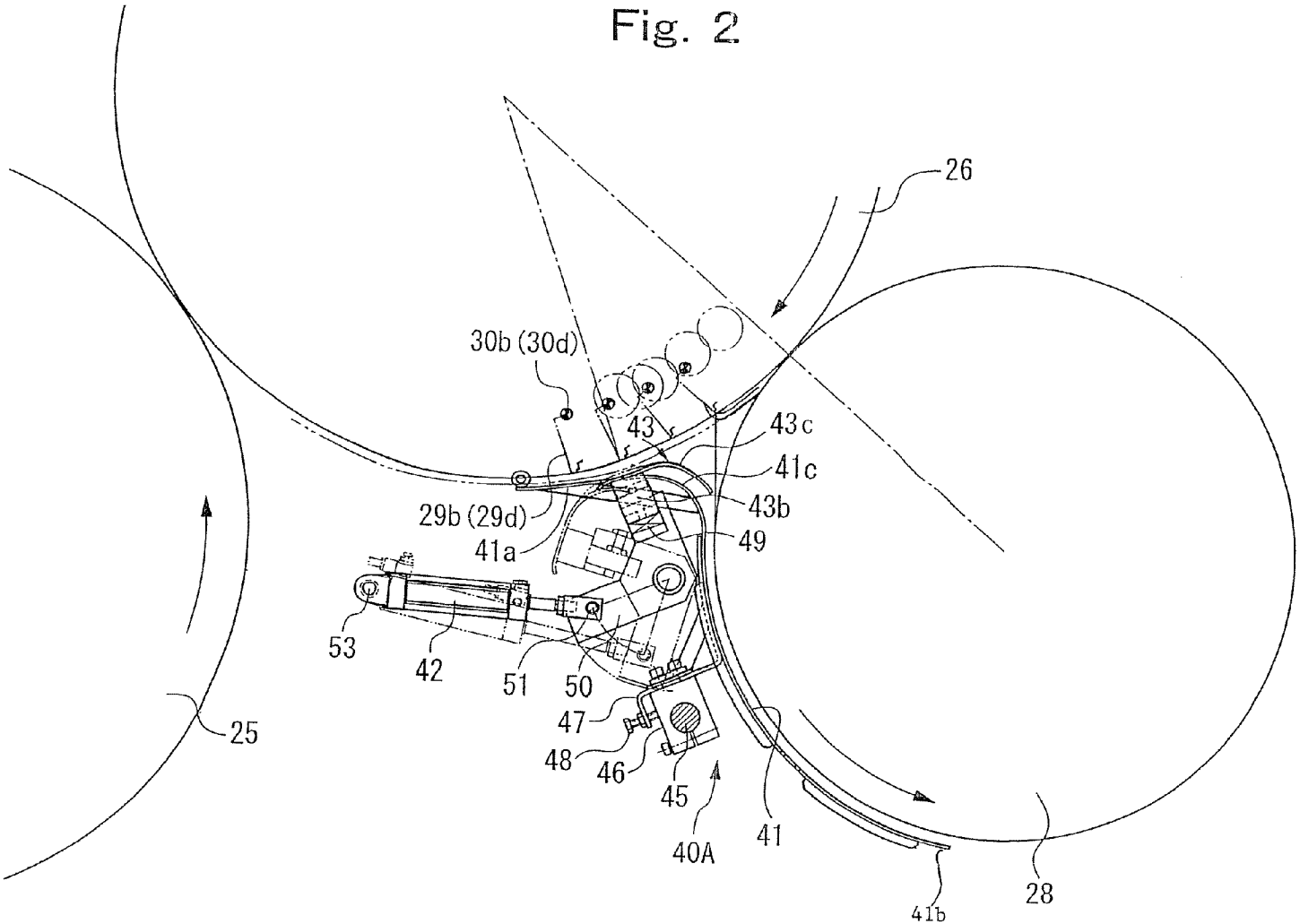
FIG. 2 is an enlarged side view of essential parts of the folding machine.
Figure 3:
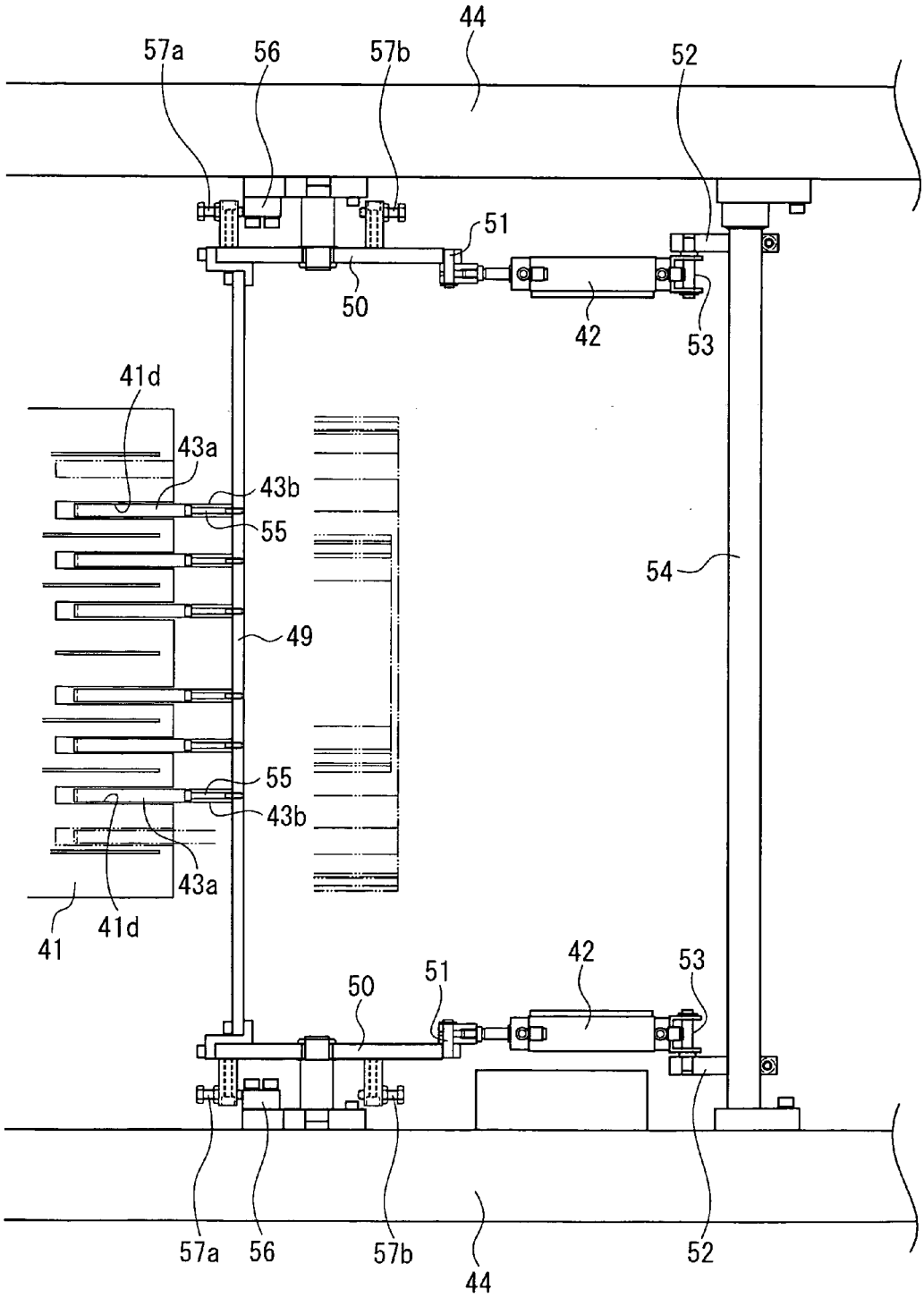
FIG. 3 is an enlarged plan view of the essential parts.
Figure 4:
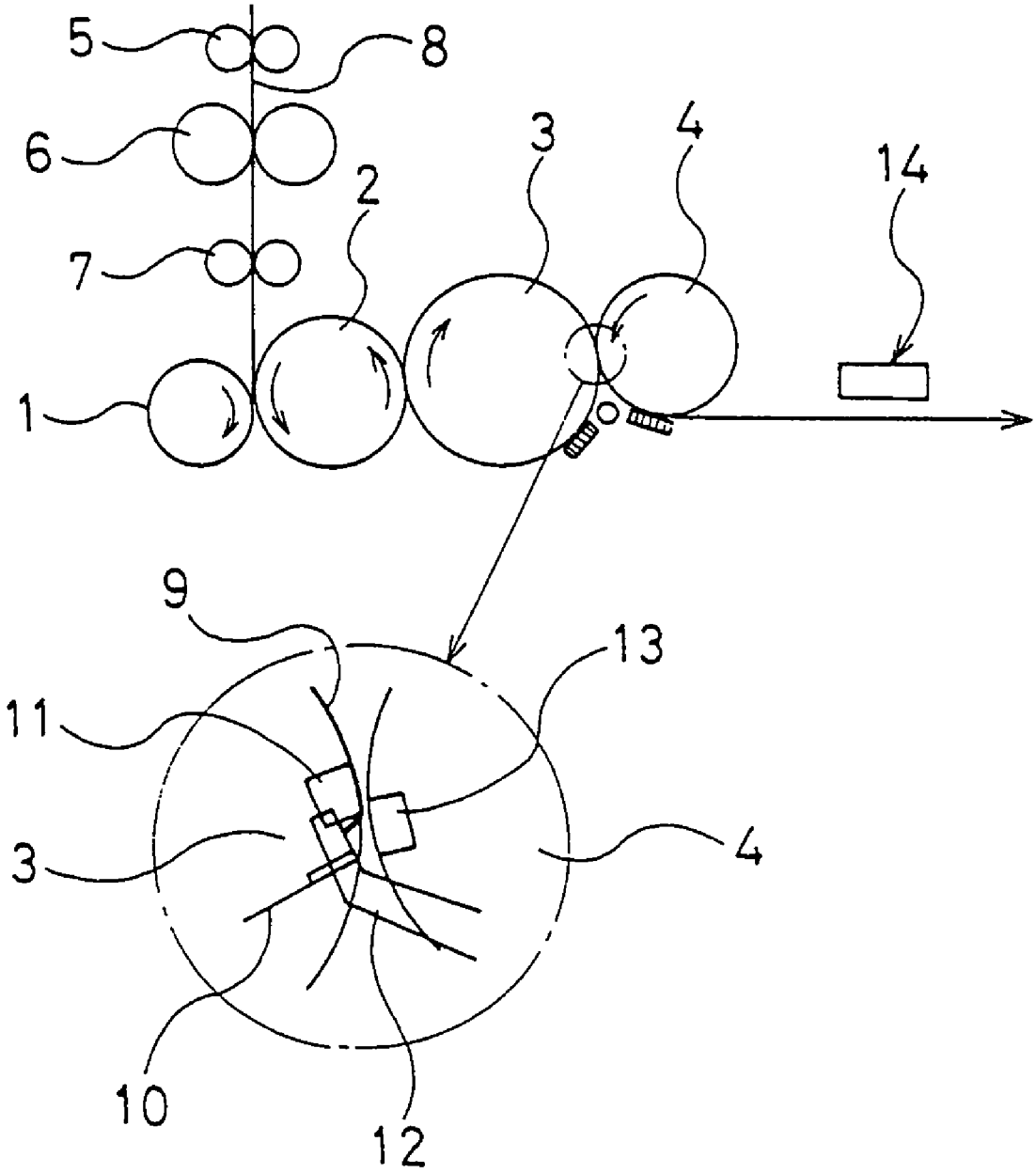
FIG. 4 is a side view of the arrangement of cylinders in a conventional folding machine.
Figure 5:
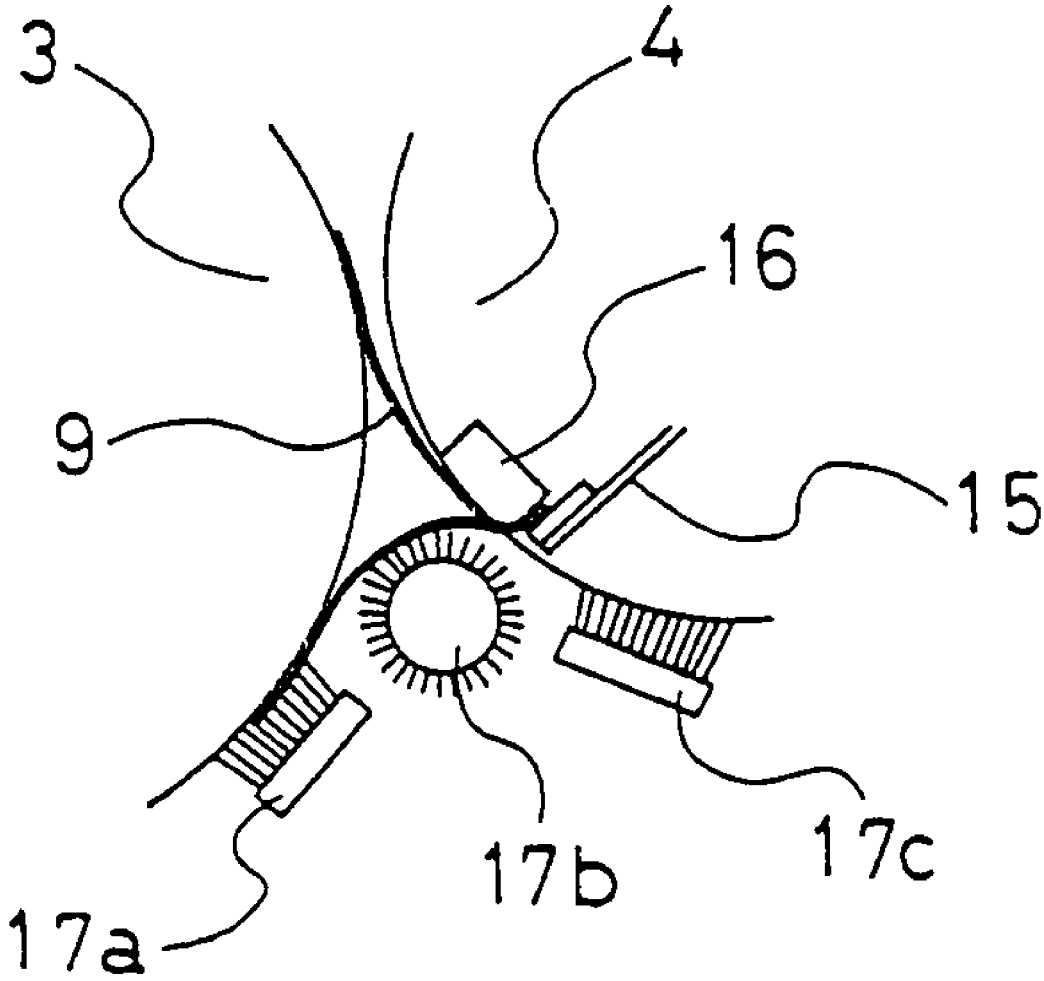
FIG. 5 is an enlarged side view of essential parts in the conventional folding machine.
Figure 6:
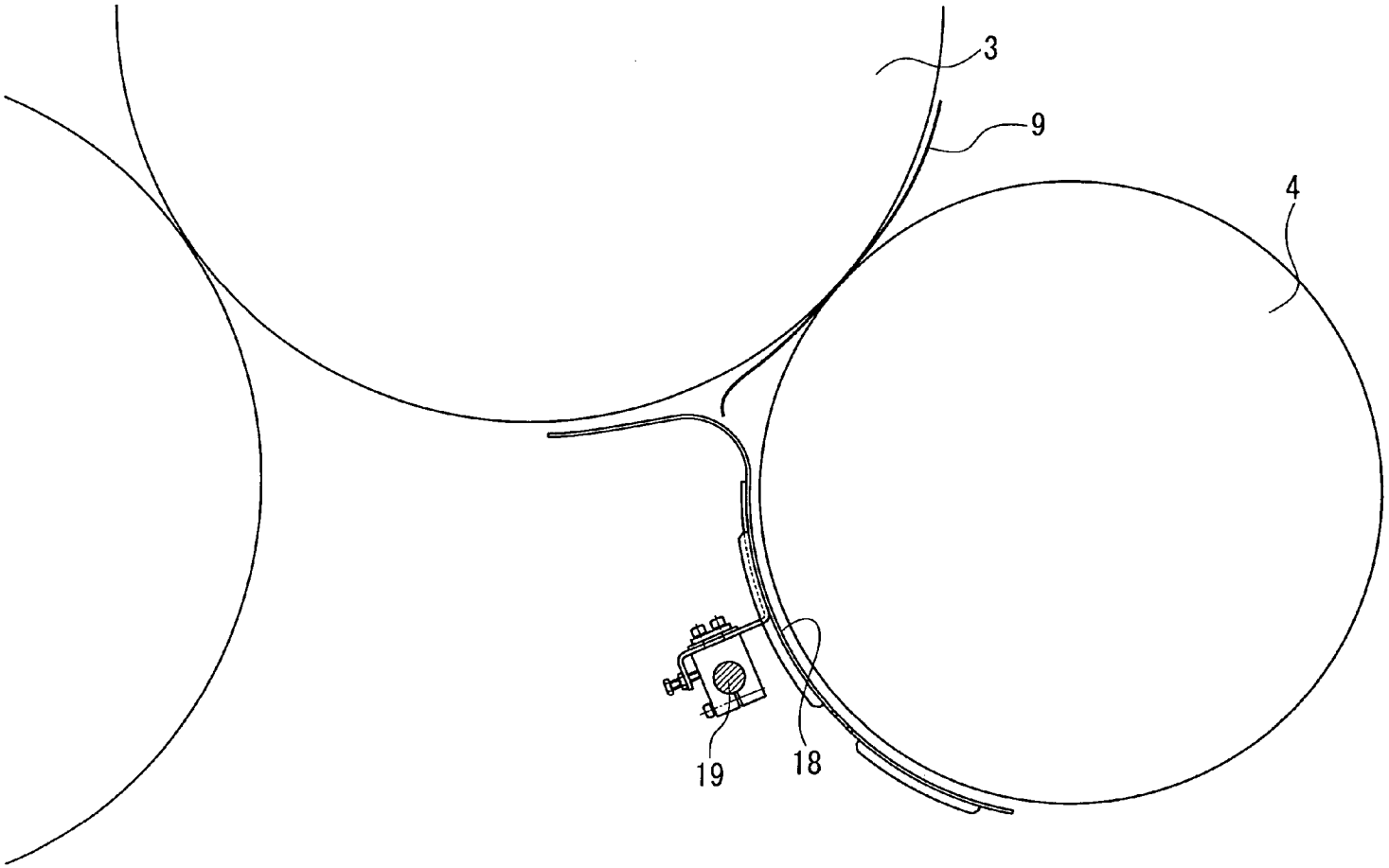
FIG. 6 is an enlarged side view of essential parts in a different example of the conventional folding machine.

Embodiment:

FIG. 1 is a schematic side view of a folding machine of a rotary printing press, showing an embodiment of the present invention. FIG. 2 is an enlarged side view of essential parts of the folding machine. FIG. 3 is an enlarged plan view of the essential parts.

As shown in FIG. 1, a web W, which has been cooled and dried after printing and then guided to an insert portion of a folding machine, is fed between a pair of nipping rollers 20→a pair of cross perforation cylinders 21→a pair of nipping rollers 22. This web W is then transported to a parallel folding apparatus 23 for cutting the web to predetermined dimensions and folding the cut web. The parallel folding apparatus 23 is equipped with a cut-off cylinder 24, a folding cylinder 25, a first jaw cylinder 26, and upper and lower second jaw cylinders 27, 28, each cylinder rotating in a direction indicated by an arrow in FIG. 1.

The web W fed between the cut-off cylinder 24 and the folding cylinder 25 is cut to predetermined dimensions by a cut-off knife (not shown) of the cut-off cylinder 24, and held by a pin (not shown) of the folding cylinder 25 to be wrapped round the lower circumferential surface of the folding cylinder 25. The cut web held by the pin is then gripped by gripper boards 29*a* to 29*d* of the first jaw cylinder 26 (the gripper boards 29*a* to 29*d* are gripping/holding means provided in large numbers in the axial direction of gripper board shafts 30*a* to 30*d* disposed at positions dividing the peripheral surface of the first jaw cylinder 26 into four equal parts) while being half-folded by a knife (not shown) of the folding cylinder 25 acting in cooperation with the gripper boards 29*a* to 29*d*. In this manner, a signature is formed and placed in contact with the upper circumferential surface of the first jaw cylinder 26. Knives 64*a* to 64*d* (gripping/holding means) are provided in large numbers in the axial direction of knife shafts 65*a* to 65*d* disposed at positions dividing the peripheral surface of the first jaw cylinder 26 into four equal parts.

Downstream of the first jaw cylinder (first cylinder) 26, the aforementioned upper second jaw cylinder 27 and the lower second jaw cylinder (second cylinder) 28 are provided in contact with the first jaw cylinder 26. Downstream of the upper second jaw cylinder 27, there are provided an upper transport belt group 31A comprising upper and lower paired transport belts, and an upper chopper folding apparatus 32A located toward a front portion of the upper transport belt group 31A. Downstream of the lower second jaw cylinder 28, there are provided a lower transport belt group 31B comprising upper and lower paired transport belts, and a lower chopper folding apparatus 32B located toward a rear portion of the lower transport belt group 31B. Downstream of the upper transport belt group 31A, there are provided a fan wheel 33 and a conveyor 34 for delivery. The first jaw cylinder 26, the upper second jaw cylinder 27, and the lower second jaw cylinder 28 are connected together by a gear mechanism (not shown) so that they rotate at predetermined rotational speeds.

Many gripper devices (gripping/holding means, hereinafter referred to as grippers) 36*a* to 36*d* are provided in the axial direction of gripper shafts 35*a* to 35*d* disposed at positions dividing the peripheral surface of the upper second jaw cylinder 27 into four equal parts. Similarly, many gripper boards (gripping/holding means) 66*a* to 66*d* are provided in the axial direction of gripper board shafts 67*a* to 67*d*. Moreover, many gripper devices (gripping/holding means, hereinafter referred to as grippers) 38*b*, 38*d* are provided in the axial direction of gripper shafts 37*b*, 37*d* disposed at positions dividing the peripheral surface of the lower second jaw cylinder 28 into two equal parts. Similarly, many gripper boards (gripping/holding means) 68*b*, 68*d* are provided in the axial direction of gripper board shafts 69*b*, 69*d*. The grippers 36*a* to 36*d* of the upper second jaw cylinder 27 are sequentially brought into opposed relationship with the gripper boards 29*a* to 29*d* of the first jaw cylinder 26, while the grippers 38*b*, 38*d* of the lower second jaw cylinder 28 are brought into opposed relationship only with the gripper boards 29*b*, 29*d* of the first jaw cylinder 26.

A cam mechanism (not shown; switching means) is provided in the first jaw cylinder 26 to switch the route of transport by performing the following so-called upward merger delivery or so-called up-and-down allocation delivery: The upward merger delivery is a procedure by which the signature transported, one signature at one time, is held by the first jaw cylinder 26 at the position of contact between the folding cylinder 25 and the first jaw cylinder 26 by actuating the gripper boards 29*a* to 29*d* at this position, and is then transferred from the gripper boards 29*a* to 29*d* of the first jaw cylinder 26 only to the grippers 36*a* to 36*d* of the upper second jaw cylinder 27. The up-and-down allocation delivery is a procedure by which the signature transported and held in the above-mentioned manner is transferred alternately from the gripper boards 29*a* to 29*d* of the first jaw cylinder 26 to the grippers 36*a*, 36*c* of the upper second jaw cylinder 27, and from the gripper boards 29*a* to 29*d* of the first jaw cylinder 26 to the grippers 38*b*, 38*d* of the lower second jaw cylinder 28.

Furthermore, the rotation phase (position) of gripper opening in the gripper boards 29*a* to 29*d* of the first jaw cylinder 26 is switched among three stages by the above cam mechanism, whereby the folding specifications for parallel folding can be changed to single folding, double folding and delta folding. In the folding cylinder 25 as well, the positional relation between the pin and the knife (not shown) can be adjusted by a double cylinder structure according to the above folding specifications. In the upper second jaw cylinder 27 and the lower second jaw cylinder 28 as well, the grippers 36*a* to 36*d* and gripper boards 66*a* to 66*d* of the upper second jaw cylinder 27, and the grippers 38*b*, 38*d* and gripper boards (gripping/holding means) 68*b*, 68*d* of the lower second jaw cylinder 28 can be switched by cam mechanisms (not shown). That is, at the time of double folding and delta folding, gripping change is performed between the knives 64*a* to 64*d* of the first jaw cylinder 26 and the gripper boards 66*a* to 66*d* of the upper second jaw cylinder 27 and between the knives 64*a* to 64*d* of the first jaw cylinder 26 and the gripper boards 68*b*, 68*d* of the lower second jaw cylinder 28. At the time of this gripping change, the gripper boards 29*a* to 29*d* of the first jaw cylinder 26 make a gripper opening motion.

Guide plates 40A, 40B, 40C of predetermined curved shapes, which guide the transport of the signature, are provided along the circumferential surface of the first jaw cylinder 26 at positions between the first jaw cylinder 26 and the respective cylinders. The guide plate (guide member) 40A between the first jaw cylinder 26 and the lower second jaw cylinder 28, as shown in FIGS. 2 and 3, comprises a stationary guide 41, which is located downstream of the point of contact between the first jaw cylinder 26 and the lower second jaw cylinder 28 in the direction of rotation and is disposed continuously along the circumferential surface of the first jaw cylinder and the circumferential surface of the lower second jaw cylinder; and a moving guide 43 disposed in such a manner as to be movable by an air cylinder (drive means) 42 between a position approaching the circumferential surface of the first jaw cylinder with respect to the stationary guide 41 (see a solid-line position in FIG. 2) and a position separated from the circumferential surface of the first jaw cylinder with respect to the stationary guide 41 (see a chain-line position in FIG. 2) in accordance with the operating speed of the folding machine.

The stationary guide 41 is fixed onto a stay bar 45, extending between frames 44 of the folding machine, via a fixing block 46 and a bracket 47. The bracket 47 has an initial position finely adjustable on the fixing block 46 via adjusting screws 48. The stationary guide 41 has a first guide surface 41*a* opposed to the first jaw cylinder 26 and having a curved portion separated by a predetermined distance from the circumferential surface of the first jaw cylinder 26; a second guide surface 41*b* opposed to the lower second jaw cylinder 28 and having a curved portion separated by a predetermined distance from the circumferential surface of the lower second jaw cylinder 28; and a third guide surface 41*c* which establishes communication between the first guide surface 41*a* and the second guide surface 41*b* in such a manner as to have a curved portion pointing toward a position where the first jaw cylinder 26 and the lower second jaw cylinder 28 are opposed to each other.

The moving guide 43 comprises a plurality of strip-shaped plate portions (moving guide portions) 43*a* mounted with predetermined spacing onto a stay bar 49, which extends in the direction of paper width, by bolts 55 via mounting portions 43*b*. The strip-shaped plate portions 43*a* can move toward and away from the circumferential surface of the first jaw cylinder through a plurality of slits (notches) 41*d* which are formed, in correspondence with the plate portions 43*a*, in an end portion, beside the first jaw cylinder, of the stationary guide 41 comprising a single plate. An end portion, on the side of the point of contact between the first jaw cylinder 26 and the lower second jaw cylinder 28, of the plate portion 43*a* is greatly curved in a direction away from the circumferential surface of the first jaw cylinder so as to be able to guide the parallel-folded signature smoothly to the circumferential surface of the lower second jaw cylinder 28. The plate portion 43*a* of the moving guide 43 also has a guide surface 43*c* having a curved portion pointing toward the position where the first jaw cylinder 26 and the lower second jaw cylinder 28 are opposed to each other.

Each end portion of the stay bar 49 is fixed to an end portion of a bell crank 50 supported by the frame 44 vertically swingably, and the front end of a piston rod of the air cylinder 42 is joined to the other end portion of the bell crank 50 by a pin 51. A head base end of the air cylinder 42 is joined to a bracket 52 by a pin 53, and the bracket 52 is secured to a stay bar 54 extending between the frames 44. In FIG. 3, reference numeral 56 denotes a stopper for restricting the moving guide 43 to the aforementioned two positions upon contact with adjusting bolts 57*a*, 57*b* annexed to the bell crank 50.

The air cylinder 42 is drivingly controlled by control means (not shown). The control means receives the folding specifications and a signal on the method of delivery (from an operating panel or the like), and a signal on the operating speed of the folding machine (from a rotary encoder or the like of a drive motor). In response to the folding specifications and such signals, the control means acts in the following manner: During a low speed operation (for example, at a speed of 200 rpm or less during acceleration at the start of operation or during speed reduction at completion of operation) in the case of double folding (and delta folding) and up-and-down allocation delivery, the control means contracts the air cylinder 42 to bring the moving guide 43 to the position closer to the circumferential surface of the first jaw cylinder than the stationary guide 41 (see the solid-line position in FIG. 2). During a high speed operation (for example, at a speed of higher than 200 rpm during a routine constant-speed operation) in such a case, on the other hand, the control means expands the air cylinder 42 to bring the moving guide 43 to the position more remote from the circumferential surface of the first jaw cylinder than the stationary guide 41 (see the chain-line position in FIG. 2).

Because of the above-described features, during a low speed operation at the time of double folding (and delta folding) and up-and-down allocation delivery, the moving guide 43 is moved to the position closer to the circumferential surface of the first jaw cylinder than the stationary guide 41. As a result, the front end of the signature gripped by the gripper board 29*b* (29*d*) of the first jaw cylinder 26 is guided into the clearance between the moving guide 43 and the circumferential surface of the first jaw cylinder at an early time point after passage through the point of contact between the first jaw cylinder 26 and the lower second jaw cylinder 28. This prevents the occurrence of the trouble, as in the earlier technologies, that the front end of the signature enters between the stationary guide 41 and the circumferential surface of the lower second jaw cylinder, with the result that the signature is folded in a bent state or a jam occurs.

On the other hand, during a high speed operation in the case of parallel folding, the moving guide 43 is moved to the position more remote from the circumferential surface of the first jaw cylinder than the stationary guide. Thus, the front end of the signature is positively guided, as usual, by inertia into the clearance between the stationary guide 41 and the circumferential surface of the first jaw cylinder, so that no problem is caused. In other words, the event that the moving guide 43 is located excessively forward (keeps staying at the position close to the circumferential surface of the first jaw cylinder), and its end portion on the side of the lower second jaw cylinder forms an edge, thereby rubbing the signature, can be avoided.

According to the present invention, as described above, the transfer of the signature between the first jaw cylinder 26 and the lower second jaw cylinder 28 in the case of double folding (and delta folding) and up-and-down allocation delivery can be performed smoothly. Furthermore, the moving guide 43 can be automatically switched between the aforementioned two positions by the control means via the air cylinder 42. Thus, prompt and accurate switching can be carried out, thereby relieving a burden on the operator. Moreover, motions of the moving guide 43 are caused by the drive means, thus facilitating automation.

Also, the moving guide 43 comprises the plurality of strip-shaped plate portions 43*a* mounted with predetermined spacing onto the stay bar 49 extending in the direction of paper width. The strip-shaped plate portions 43*a* can move toward and away from the circumferential surface of the first jaw cylinder through the plurality of slits 41*d* which are formed, in correspondence with the plate portions 43*a*, in the end portion, beside the first jaw cylinder, of the stationary guide 41 comprising a single plate. Thus, the stationary guide 41 can be formed from a single plate, providing the advantage that its production is easy. Of course, the stationary guide 41 may also be composed of strip-shaped plate portions.

Besides, the guide plate 40A, which comprises the stationary guide 41 and the moving guide 43, is provided at the site between the first jaw cylinder 26 and the lower second jaw cylinder 28, the site where the aforementioned trouble during a low speed operation is particularly liable to occur. This affords the advantage that the aforementioned trouble at this site during a low speed operation can be reliably resolved. It goes without saying that the same structure as that of the guide plate 40A may be adopted for the guide plate provided at the site between the first jaw cylinder 26 and the upper second jaw cylinder 27.

While the present invention has been described by the above embodiment, it is to be understood that the invention is not limited by this embodiment, but may be varied or modified in many other ways. For example, the transfer of the signature from the gripper boards to the grippers may be changed to the transfer of the signature from the grippers to the grippers. Moreover, the first jaw cylinder is disclosed as an example of the first cylinder, and the second jaw cylinder (upper second jaw cylinder, lower second jaw cylinder) is disclosed as an example of the second cylinder. However, the folding cylinder may be the first cylinder, and the first jaw cylinder may be the second cylinder. Furthermore, the stationary guide may comprise a plurality of strip-shaped members, which may be fixed with predetermined spacing onto the stay bar extending between the frames. Such variations or modifications are not to be regarded as a departure from the spirit and scope of the invention, and all such variations and modifications as would be obvious to one skilled in the art are intended to be included within the scope of the appended claims.

What is claimed is:

1. A parallel folding apparatus of a folding machine, comprising:

a first cylinder and a second cylinder arranged, with circumferential surfaces of said first cylinder and said second cylinder being in contact with each other;

a guide member for guiding a signature which is transported on a lower circumferential surface of said second cylinder after being parallel-folded by gripping/holding means of said second cylinder in cooperation with knives of said first cylinder, said guide member including, a stationary guide which is located downstream, in a rotating direction, of a point of contact between said first cylinder and said second cylinder and disposed along the circumferential surface of said first cylinder and the circumferential surface of said second cylinder, and a moving guide which is disposed in such a manner as to be movable by drive means in accordance with an operating speed of said folding machine between a close position, where said moving guide is moved to a position closer to the circumferential surface of said first cylinder and the circumferential surface of said second cylinder than said stationary guide inside an area defined by said first cylinder, said second cylinder and said stationary guide, and a remote position, where said moving guide is moved to a position as remote as, or outside said area and more remote than, said stationary guide, and wherein said first cylinder is a first jaw cylinder for forming a signature in cooperation with a folding cylinder, and said second cylinder is a second jaw cylinder for folding said signature in cooperation with said first jaw cylinder or for receiving said signature from said first jaw cylinder without folding said signature.

2. The parallel folding apparatus of a folding machine according to claim 1, wherein said moving guide has moving guide portions separated from one another by a predetermined spacing in an axial direction, said stationary guide has stationary guide portions separated from one another by a predetermined spacing in an axial direction, and said moving guide portions can advance and retreat through said spacings between said stationary guide portions.

3. The parallel folding apparatus of a folding machine according to claim 2, wherein a plurality of said moving guide portions are supported with spacing by a support member, and said stationary guide has a plurality of notches corresponding to said moving guide portions.

4. The parallel folding apparatus of a folding machine according to claim 1, wherein said second cylinder is located below said first cylinder and makes contact with said first cylinder.

5. The parallel folding apparatus of a folding machine according to claim 1, wherein said drive means acts to locate said moving guide at said close position when the operating speed of said folding machine is equal to or lower than a predetermined speed, and to locate said moving guide at said remote position when the operating speed of said folding machine exceeds said predetermined speed.

6. The parallel folding apparatus of a folding machine according to claim 5, wherein said predetermined speed is 200 rpm.

7. The parallel folding apparatus of a folding machine according to claim 5, wherein said moving guide is located at said close position when the signature is folded between said first cylinder and said second cylinder.

8. The parallel folding apparatus of a folding machine according to claim 5, wherein said moving guide is located at said remote position when the signature is not folded between said first cylinder and said second cylinder.

9. The parallel folding apparatus of a folding machine according to claim 1, wherein said second cylinder is a lower second jaw cylinder.

10. The parallel folding apparatus of a folding machine according to claim 1, further comprising an upper second jaw cylinder which is opposed to said first jaw cylinder on a side upstream, in a rotating direction of said first jaw cylinder, of an opposing position where said first jaw cylinder and said lower second jaw cylinder are opposed to each other, and on a side downstream, in the rotating direction of said first jaw cylinder, of an opposing position where said folding cylinder and said first jaw cylinder are opposed to each other.

11. A parallel folding apparatus of a folding machine, comprising:

a first cylinder and a second cylinder arranged, with circumferential surfaces of said first cylinder and said second cylinder being in contact with each other;

a guide member for guiding a signature which is transported on a lower circumferential surface of said second cylinder after being parallel-folded by gripping/holding means of said second cylinder in cooperation with knives of said first cylinder, said guide member including a stationary guide which is located downstream, in a rotating direction, of a point of contact between said first cylinder and said second cylinder and disposed along the circumferential surface of said first cylinder and the circumferential surface of said second cylinder, and a moving guide which is disposed in such a manner as to be movable by drive means in accordance with an operating speed of said folding machine between a close position, where said moving guide is moved to a position closer to the circumferential surface of said first cylinder and the circumferential surface of said second cylinder than said stationary guide inside an area defined by said first cylinder, said second cylinder and said stationary guide, and a remote position, where said moving guide is moved to a position as remote as, or outside said area and more remote than, said stationary guide, wherein said stationary guide has a first guide surface opposed to said first cylinder and having a curved portion separated by a predetermined distance from the circumferential surface of said first cylinder; a second guide surface opposed to said second cylinder and having a curved portion separated by a predetermined distance from the circumferential surface of said second cylinder; and a third guide surface which establishes communication between said first guide surface and said second guide surface in such a manner as to have a curved portion pointing toward a position where said first cylinder and said second cylinder are opposed to each other, and said moving guide has a guide surface having a curved portion pointing toward the position where said first cylinder and said second cylinder are opposed to each other.

12. The parallel folding apparatus of a folding machine according to claim 11, wherein said close position is a position where said guide surface is closer than said third guide surface to the position where said first cylinder and said second cylinder are opposed to each other.

* * * * *